US007328810B1

(12) United States Patent
Rhodes

(10) Patent No.: US 7,328,810 B1
(45) Date of Patent: Feb. 12, 2008

(54) CRANE SUPPORTING APPARATUS

(76) Inventor: Lester Kent Rhodes, P.O. Box 877, Beaver, OK (US) 73932

( * ) Notice: Subject to any disclaimer, the term of this patent is extended or adjusted under 35 U.S.C. 154(b) by 266 days.

(21) Appl. No.: 10/743,630

(22) Filed: Dec. 22, 2003

(51) Int. Cl.
*B66C 23/80* (2006.01)

(52) U.S. Cl. ..... 212/180; 212/301; 212/304

(58) Field of Classification Search ..... 212/180, 212/301–306; 280/765.1
See application file for complete search history.

(56) References Cited

U.S. PATENT DOCUMENTS 3,042,236 A * 7/1962 Pilch ..... 74/105
3,261,478 A * 7/1966 Sonerud ..... 212/306
3,586,113 A * 6/1971 Grant ..... 173/34
3,627,268 A * 12/1971 Wills ..... 254/423
3,638,805 A * 2/1972 Garnier ..... 212/175
3,732,996 A * 5/1973 Bauer ..... 414/815
3,795,332 A * 3/1974 Eriksson ..... 414/539
3,977,547 A * 8/1976 Holopainen ..... 414/687
4,150,504 A * 4/1979 Asche ..... 37/403
4,386,711 A * 6/1983 Gattu et al. ..... 212/303
4,394,913 A * 7/1983 Lanning et al. ..... 212/304
4,431,363 A * 2/1984 Waite ..... 414/687
4,960,359 A * 10/1990 Lovitt, Jr. ..... 414/686
4,991,673 A * 2/1991 Ericsson ..... 180/41
5,014,863 A * 5/1991 Vlaanderen ..... 212/299
5,106,255 A * 4/1992 Motoda et al. ..... 414/540
5,120,186 A * 6/1992 Jorgenson ..... 414/686
5,387,071 A * 2/1995 Pinkston ..... 414/563
5,819,445 A * 10/1998 LaBelle et al. ..... 37/404
5,850,704 A * 12/1998 Harinen ..... 37/468
6,076,615 A * 6/2000 Dalland et al. ..... 173/42
6,516,917 B1 * 2/2003 Mayer et al. ..... 182/17

* cited by examiner

*Primary Examiner*—Thomas J. Brahan
(74) *Attorney, Agent, or Firm*—Kenneth H. Jack; Davis & Jack, L.L.C.

(57) ABSTRACT

A crane support consisting of a steel square tubing pedestal having an apertured mounting plate fixedly attached to its upper end, and having an enlarged base fixedly attached to its lower end; an axle, the pedestal being mounting rotatably upon the axle; an auxiliary implement mounting frame fixedly attached to a rearward end of the axle, such mounting plate being adapted for attachment to skid steer loader lift arms and bucket dumping rams; a pair of telescoping outriggers fixedly attached to and extending laterally from the pedestal, each outrigger arm having downwardly extendable and upwardly retractable foot fixedly attached to its distal end; a plurality of hydraulic cylinders operatively connected to the telescoping outriggers and to the feet for alternating lateral and vertical extensions and retractions; and a hydraulic cylinder connected operatively to the pedestal for alternately locking the pedestal against rotation with respect to the mounting frame and permitting such rotation.

11 Claims, 4 Drawing Sheets

CRANE SUPPORTING APPARATUS

FIELD OF THE INVENTION

This invention relates to heavy construction equipment. More particularly, this invention relates to machinery adapted for transporting, supporting, positioning, and stabilizing load lifting cranes.

BACKGROUND OF THE INVENTION

Load lifting cranes are commonly mounted upon the load bearing bed of a common truck. Such a configuration advantageously provides for stable vertical support of the crane. A drawback or disadvantage of such configuration relates to crane leveling and maneuvering. Trucks typically are difficultly leveled or stabilized upon uneven or sloped construction site surfaces. Also, trucks often are unable to traverse soft ground surfaces, and are unable to maneuver between closely spaced obstacles. Such disadvantages prevent truck mounted load lifting cranes from being utilized at many construction sites.

Construction site locations which are unreachable via a truck are commonly reachable via more mobile and maneuverable construction vehicles such as skid steer loaders, front loader tractors, and wheel loaders. However, such vehicles typically present no load bearing surface which is suitable for transporting, supporting, positioning, and stabilizing a load lifting crane.

The instant inventive crane support apparatus solves or ameliorates the crane related defects and deficiencies of trucks and loader vehicles noted above, while advantageously serving all of the above noted positive function of such vehicles. The invention accomplishes such objectives by providing a preferably hydraulically actuated auxiliary implement which is attachable to the lift arms and bucket dumping ram or rams of a skid steer loader, of a front loader tractor, or of a wheel loader. Such implement is capable of supporting a load lifting crane, provides for pivotal vertical alignment of such crane about both a lateral and a longitudinal axis, and provides for firm lateral and longitudinal stabilization of such crane.

BRIEF SUMMARY OF THE INVENTION

A first major structural component of the instant inventive crane supporting apparatus comprises a pedestal having a front side, a rear side, opposing lateral sides, a longitudinal axis extending horizontally from the front side to the rear side, and a lateral axis extending horizontally between the lateral sides. Necessarily, the pedestal has sufficient size and strength to securely support at its upper end a load lifting crane. Preferably, the pedestal comprises a length of steel square tubing approximately four feet long, and preferably having horizontal cross-sectional dimensions of one foot by one foot. Suitably, the pedestal may alternately be configured as an open web steel weldment. Suitably, though less desirably, the pedestal may comprise other commonly known structural support materials such as stainless steel, aluminum, wood, plastic, fiberglass, or other laminate composite materials.

A crane mounting means is necessarily fixedly attached to or formed wholly with the upper end of the pedestal. A preferred crane mounting means comprises a mounting plate having a peripheral outwardly extending flange and having mounting bolt receiving apertures or slots extending vertically through such flange. Suitably, the crane mounting means may be alternately configured to include a sleeve or pin of a common slip sleeve and slip pin joint. Other commonly known equipment mounting and attaching means fall within the scope of the invention and may be suitably alternately attached to the upper end of the pedestal. Suitably, though less desirably, the crane attaching means may comprise a heat fusion weld at the upper end of the pedestal, permanently attaching a crane. An enlarged base is preferably fixedly welded to or formed wholly with the lower end of the pedestal for enhanced ground floatation and pedestal stabilization.

First means for alternately pivoting and counter-pivoting the pedestal are necessarily provided, such means being operatively connected to the pedestal, and such means being capable of controlling rotating or pivoting motions of the pedestal about its lateral axis. Preferably, such first means comprises a rectangular mounting frame which is preferably configured to include a solid rectangular steel plate. Preferably, the mounting frame further comprises lift arm and bucket dumping ram attaching means for facilitating removable attachment of the mounting plate to the lift arms and bucket dumping ram of a common skid steer loader, of a front loader tractor, or of a wheel loader vehicle. Preferably, the means for lift arm and bucket dumping ram attachment comprises an upper hook plate and lower eye or wedge receiving plate combination of the type which is commonly utilized for engagement with quick coupling lift arm adapter mechanisms. Suitably, the means for attachment to such lift arms and bucket dumping ram may comprise the clevises or eyes of pin, eye, and clevis combinations. The pedestal is preferably mechanically linked to the mounting frame so that, upon attachment of the mounting frame to, for example, the lift arms and bucket dumping ram of a skid steel loader, alternate extension and retraction of such loader's bucket dumping ram alternately pivots and counter-pivots both the mounting frame and the pedestal about the lateral axis.

A second means for alternately and pivoting and counter-pivoting the pedestal is necessarily provided. Such second means is necessarily operatively connected to the pedestal for controlling rotating or pivoting motions of the pedestal about its longitudinal axis. Preferably, such means comprises a longitudinally aligned axle having a base end which is fixedly mounted upon the mounting frame, the pedestal being mounted pivotally or rotatably on such axle. Suitably, the base of the axle may be alternately mounted fixedly upon the pedestal, such axle having a rearward end mounted rotatably or pivotally upon the mounting plate. The axle is preferably configured as a solid shaft or pipe. Suitably, the axle may be alternately configured as a plurality of "T" headed slide lugs which are contained within and are radially guided by arcuate slots.

The means for alternately pivoting and counter-pivoting the pedestal about its longitudinal axis preferably further comprises laterally extending or cantilevered outriggers which are fixedly mounted upon the pedestal. Preferably, such outriggers are segmented, the segments comprising quill and slide shaft combinations, the slide shafts of such combinations preferably being alternately laterally extendable and laterally retractable via two way hydraulic cylinders. Where the slide shafts of the outriggers' quill and slide shaft combinations extend substantially horizontally over the ground (as opposed to being angled downwardly for direct ground engagement), downwardly extendable and upwardly retractable feet are preferably provided, each foot being fixedly attached to the distal end of one of the outriggers' slide shafts. Like the outriggers, the feet attached to the distal ends of the outriggers preferably comprise quill and slide shaft combinations which facilitate the alternate downward extensions and upward retractions of lower ends of the slide shafts. The alternate downward extensions and upward retractions of the slide shafts of the feet are preferably powered by two way hydraulic cylinders.

Suitably, though less desirably, the means for alternately pivoting and counter-pivoting the pedestal about its longitudinal axis may comprise laterally extending articulating legs, each leg having a proximal end pivotally mounted upon the pedestal, each leg having a ground engaging foot at its distal end, and each leg being alternately upwardly and downwardly pivotable via triangulating two way hydraulic cylinders.

Suitably, the hydraulic cylinders which laterally extend and retract the outriggers' slide shafts, and which vertically extend and retract the slide shafts of the feet may be replaced by electric motor or hydraulic motor powered jack screw assemblies, or by electric motor or hydraulic motor powered rack and pinion gear assemblies.

In use of the instant inventive crane support, assuming adoption of a configuration consistent with the preferred embodiment described above, and assuming that the crane support is attached as an auxiliary implement upon a skid steer loader vehicle having a quick coupling adapter plate attached to its lift arms and bucket dumping ram, such adapter plate is engaged with the hook and eye plates of the crane support's mounting frame. Upon such engagement, the crane support is securely mounted upon such skid steer loader. Thereafter, a load lifting crane is fixedly bolted to the pedestal's upper crane mounting plate. Thereafter, alternate extension and retraction of the skid steer loader's bucket dumping ram operatively pivots both the mounting frame and the attached pedestal about the lateral axis, allowing the pedestal to be accurately vertically oriented within a longitudinally extending vertical plane.

Operation of the foot actuating hydraulic cylinders for alternate downward extension and upward retraction of the distally mounted slide shafts varyingly engages the ground at points laterally removed from the pedestal. An operator's control and adjustment of such lateral ground engagement may pivot the pedestal about its longitudinally extending axle and axis for accurate vertical positioning of the pedestal within a laterally extending vertical plane.

Operation of the outrigger actuating hydraulic cylinders to fully extend the outriggers stabilizes the pedestal against lateral side to side tipping of the crane, while the rearwardly extending mass of the attached skid steer loader vehicle stabilizes the pedestal against forward and rearward tipping.

In order to utilize the crane support for moving and transporting such exemplary attached crane, the feet of the crane support and the lift arms of the exemplary skid steer are preferably respectively upwardly retracted and raised so that the feet and the base of the pedestal clear the ground. After raising such ground engaging elements over the ground surface, the crane support and attached crane may undesirably freely picot about the longitudinal axis. In order to resist such undesirable pivoting motion, releasable locking means operatively connected to the pedestal are preferably provided. Preferably, the releasable locking means comprises a two way hydraulic cylinder which further mechanically links the axle and the pedestal, and which is mounted upon those structures for controlling pivotal motion of the pedestal with respect to the axle and with respect to the mounting frame. Suitably, the releasable locking means may alternately comprise a slide plate and clamp lock assembly, a pin and eye lock assembly, or other commonly known releasable locking or latching mechanisms.

Where a heavy load is borne by a crane attached to the upper end of the pedestal, and where the load is extended forwardly, large torsional forces may be applied to the pedestal and to the mounting plate, such forces tending to twist or rotate the mounting plate about the lateral axis. In order to prevent such torsional forces from overloading the mechanical linkages between the exemplary skid steer loader and the mounting plate, a forwardly and downwardly extending outrigger is preferably fixedly attached to the forward end of the pedestal. Preferably, the forwardly and downwardly extending outrigger is configured as a hydraulic ram actuated telescoping quill having a pivoting ground engaging foot at its distal end. Upon extension of such outrigger's foot for ground engagement, such outrigger advantageously relieves the undesirable torsional forces described above.

Accordingly, it is an object of the present invention to provide a crane support incorporating a pedestal having an upper end adapted for crane attachment, the pedestal comprising means for controlling pivoting and counter-pivoting motions of the pedestal about longitudinal and lateral axes.

It is a further object of the present invention to provide such a crane support which is adapted for attachment to the lift arms and bucket dumping ram of a common skid loader, front loader tractor, or wheel loader vehicle, the pivoting and counter-pivoting motions about the lateral axis being controllable via actuation of such vehicle's bucket dumping ram.

A further object of the present invention is to provide such a crane support which is further adapted for controlling pivoting motions about a longitudinal axis by providing ground engaging cantilevered outriggers or articulating arms.

A further object of the present invention is to provide such a crane support which is further adapted for controlling torsional twisting about the lateral axis by providing a telescoping forwardly and downwardly extending outrigger.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
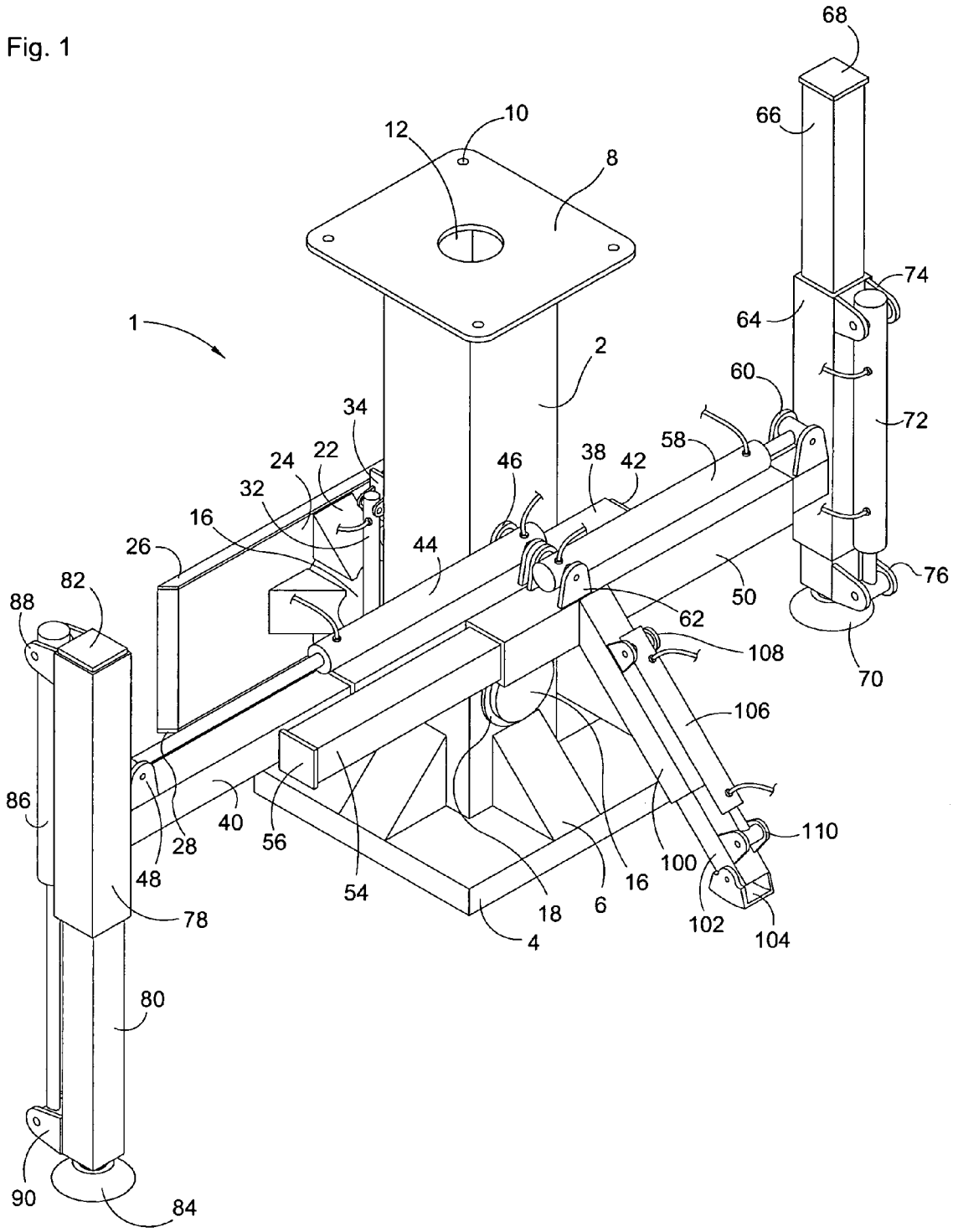
FIG. 1 is an isometric view of a preferred embodiment of the instant inventive crane support.
Figure 3:
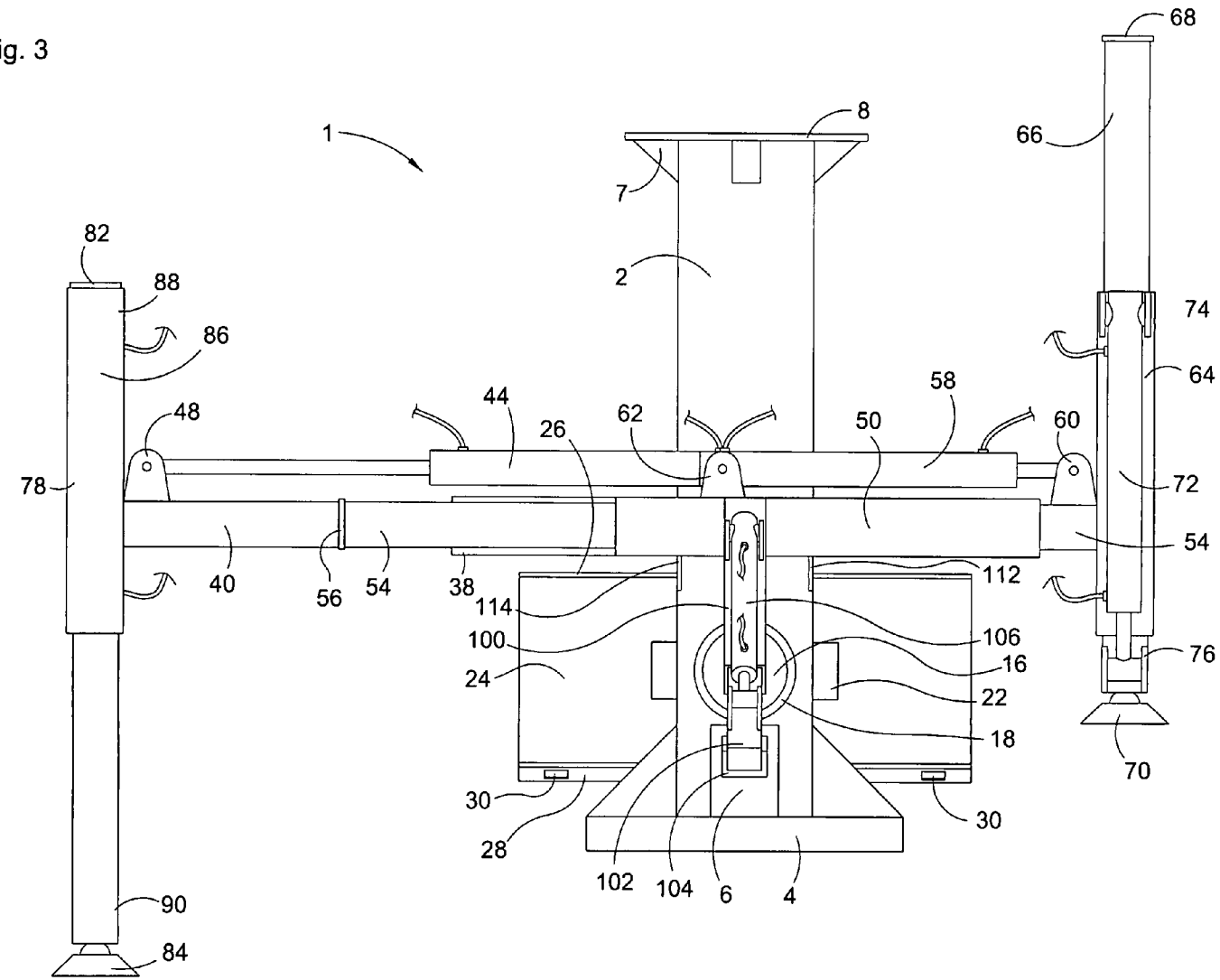
FIG. 3 is a front view of the mechanism of FIG. 1.

Referring now to the drawings, and in particular to FIG. 1, a preferred embodiment of the instant inventive crane support is referred to generally by Reference Arrow 1. A major structural component of the crane support 1 is a pedestal 2, preferably comprising 1'×1' steel square tubing. The pedestal 2 has a crane mounting plate 8 fixedly welded to its upper end, such plate 8 having bolt receiving apertures 10 extending therethrough, and having a hydraulic line receiving aperture 12 extending centrally therethrough. An enlarged base 4 is preferably fixedly welded to the lower end of the pedestal 2, the base 4 preferably being stiffened and supported by triangulating braces 6. Referring further to FIG. 3, the crane mounting plate is similarly supported by triangulating braces 7.

Figure 2:
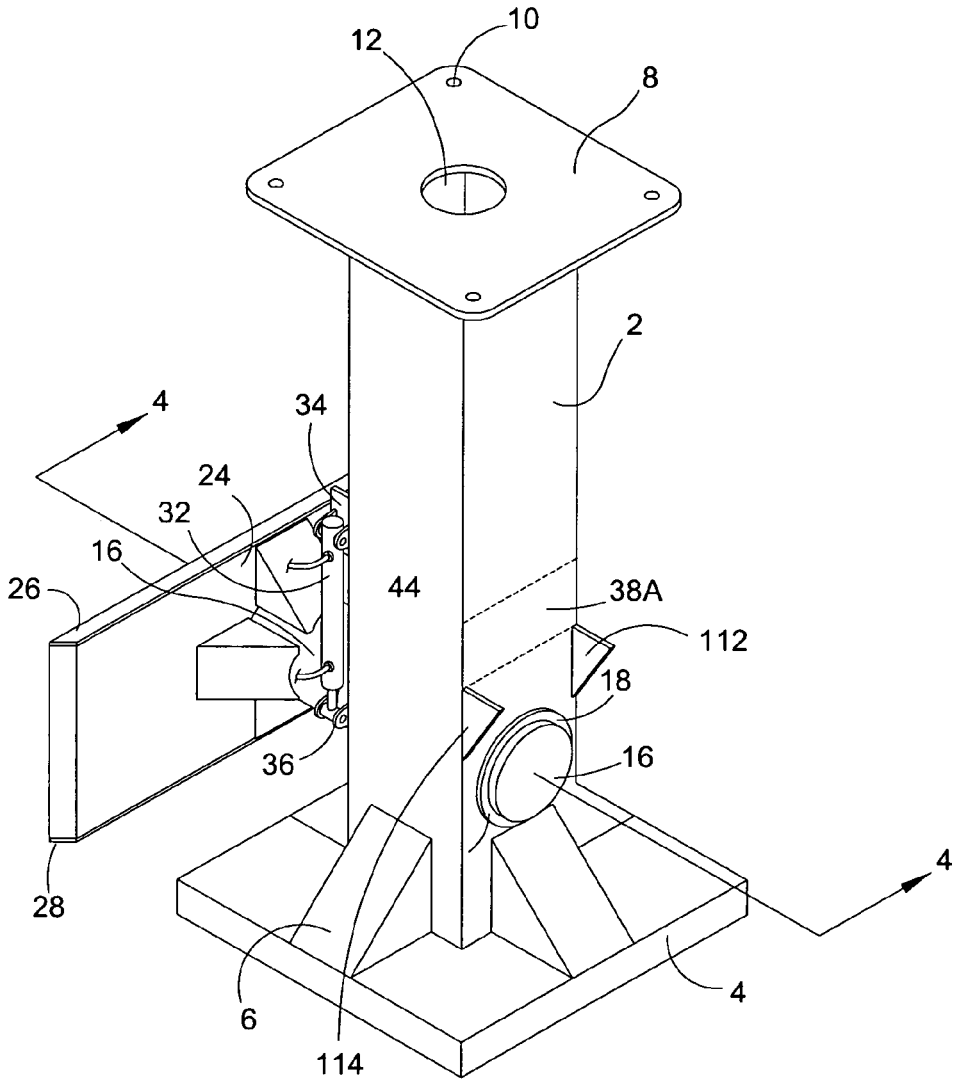
FIG. 2 redepicts FIG. 1 showing outriggers and ground engaging feet assembly removed.
Figure 4:
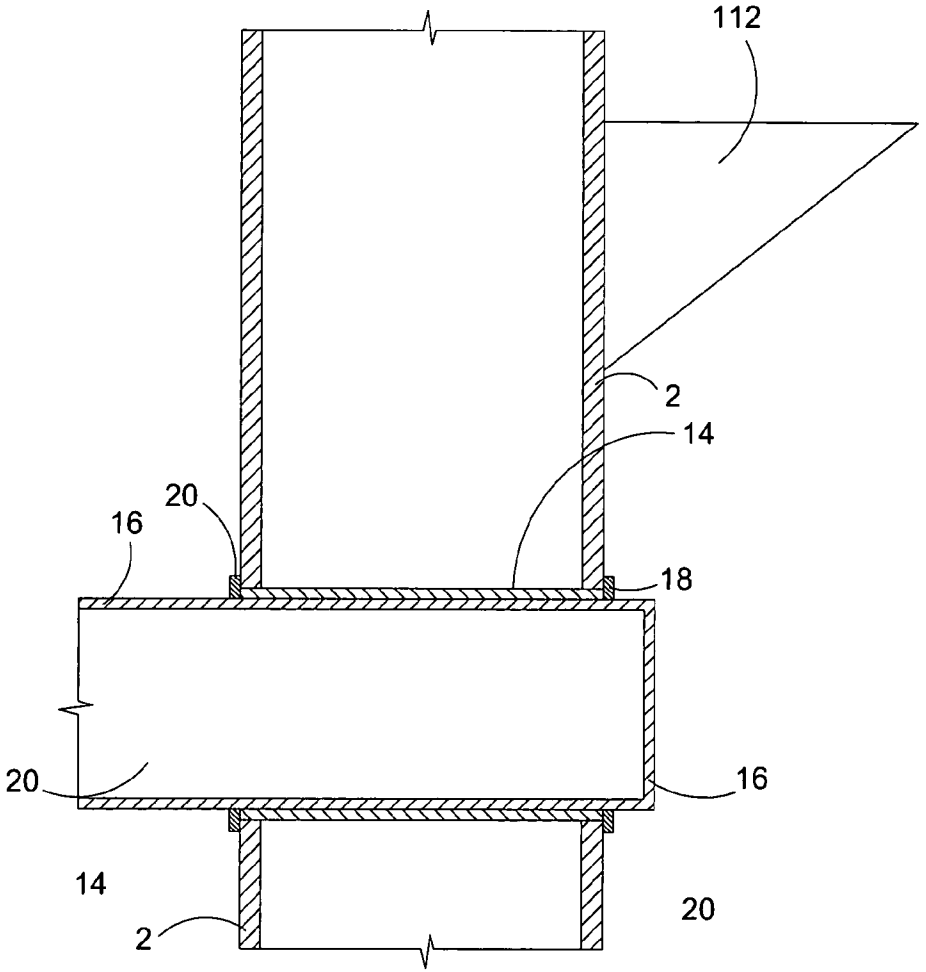
FIG. 4 is a sectional view as indicated in FIG. 2.

Referring simultaneously to FIGS. 1, 2, and 4, an axle receiving bearing sleeve 14 extends through and is fixedly welded within the pedestal 2, such bearing sleeve 14 slidably and rotatably receiving an axle 16. The axle 16 is preferably longitudinally retained within the bore of bearing sleeve 14 by slide stopping collars 18 and 20, such collars being fixedly welded to axle 16. In operation of the crane support 1, the pedestal 2 may pivot and counter-pivot about the longitudinally extending axis of axle 16.

Referring simultaneously to FIGS. 1 and 2, the rearward end of axle 16 is preferably fixedly welded to a mounting frame 24 and triangulating braces 22 are welded both to the mounting frame 24 and the axle 16 for rigidly support the axle 16 upon mounting frame 24.

Referring simultaneously to FIGS. 1, 2, and 3, a lift arm adapter engaging hook plate 26 is preferably fixedly welded to the upper end of mounting frame 24, and a similar plate 28 having eyes 30 is fixedly welded to the lower end of mounting frame 24. In operation of the crane support 1, a quick coupling adapter plate (not depicted) attached to the lift arms and bucket dumping ram of a skid steer loader, a front loader tractor, or a wheel loader vehicle (not depicted) extends upwardly and forwardly beneath hook plate 26 and engages eyes 30 with downwardly extendable wedges or lugs (not depicted) for secure attachment to such exemplary vehicle.

Referring to FIG. 1, a steel square tubing quill 38 is preferably fixedly welded to the forward face of pedestal 2, and a second steel square tubing quill 50 is similarly fixedly welded to the forward face of steel square tubing quill 38. Referring further to FIG. 2, the dashed line zone 38A delineates the preferred positioning of the welded attachment of steel square tubing quill 38. Slide shafts 40 and 54 are respectively slidably mounted within and through the bores of quills 38 and 50, the proximal ends of the slide shafts 40 and 54 respectively having slide stops 42 and 56 fixedly welded thereto. Two way hydraulic cylinders 44 and 58 control lateral extensions and retractions of slide shafts 38 and 54, the rearward hydraulic cylinder 44 being mounted upon devises 46 and 48, and the forward hydraulic cylinder 58 being mounted upon devises 60 and 62. In operation of the crane support 1, actuation of hydraulic cylinders 44 and 58 may laterally outwardly extend slide shafts and 40 and 54, while opposite actuation of such hydraulic cylinders laterally inwardly retracts such slide shafts.

Referring further to FIG. 1, ground engaging foot assemblies are preferably fixedly attached to the distal ends of slide shafts 40 and 54, such assemblies preferably comprising quill and slide shaft combinations which comprise square tubing steel quills 64 and 78 and slidably received slide shafts 66 and 80. Downward sliding extension of slide shafts 66 and 80 is preferably stopped by end caps 68 and 82 which are preferably respectively welded to the upper ends of slide shafts 66 and 80. Swivel plates 70 and 84 are preferably pivotally attached to the lower ends of slide shafts 66 and 80. Alternate upward retraction and downward extension of slide shafts 66 and 80 is preferably powered by two way hydraulic cylinders 72 and 86, such cylinders being operatively connected to the quills 64 and 78, and to the slide shafts 66 and 80 by clevis mounts 74, 76, 88, and 90.

In operation of the crane support 1, actuation of hydraulic cylinders 72 and 86 to downwardly extend their shafts downwardly extends slide shafts 66 and 80, while opposite actuation of said hydraulic cylinders upwardly retracts said shafts.

Referring to FIG. 2, a clevis mount 34 is fixedly attached to and extends rearwardly from the rearward face of pedestal 2, and clevis mount 36 is fixedly attached to axle 16. A two way hydraulic cylinder 32 spans between and interconnects clevis mounts 34 and 36. Referring simultaneously to FIGS. 1 and 2, in operation of the crane support 1, operation of hydraulic control valves (not depicted) for fluid locking of hydraulic cylinder 32 resists pivotal motion of pedestal 2 with respect to axle 16 and with respect to mounting frame 24. Conversely, the release of such hydraulic lock permits such pivotal motion.

Referring simultaneously to FIGS. 1 and 3, a forwardly and downwardly extending forward torque resisting outrigger comprising a quill 100 and slide shaft 102 is preferably fixedly attached to the forward face of quill 50. The forward torque resisting outrigger has a pivoting ground engaging foot 104, and such outrigger is preferably actuated by a two way hydraulic cylinder 106 mounted upon devises 108 and 110.

Referring to FIGS. 1-3, triangulating braces 112 and 114 preferably further interconnect quill 38 and pedestal 2, providing for rigid support and attachment of the outrigger assembly.

Referring simultaneously to all figures, in operation of the instant inventive crane support 1, and upon attachment of the crane support 1 to an exemplary skid steel loader, as described above, alternate extension and retraction of such vehicle's bucket dumping ram pivots the pedestal 2 along with attached crane (not depicted) about a laterally extending axis, allowing such crane and the pedestal 2 to be accurately vertically oriented within a vertically and longitudinally extending plane. Actuations of hydraulic cylinders 72 and 86 for coordinated downward extension and upward retraction of slide shafts 66 and 80 similarly pivots and counter-pivots the pedestal 2 about the longitudinal axis, providing for accurate vertical orientation of the pedestal 2 and crane within a laterally extending vertical plane. Through coordinated actuations of the bucket dumping ram of such exemplary vehicle and of hydraulic cylinders 72 and 86, a precise vertical orientation of pedestal 2 may be achieved and maintained.

The pedestal 2 and the exemplary crane may be laterally stabilized through operation of two way hydraulic cylinders 44 and 58. For maximum lateral stabilization, such cylinders are preferably actuated to fully outwardly extend slide shafts 40 and 54 along with their distally attached quill and slide shaft foot assemblies. For purposes of facilitating movement and maneuverability of the crane support 1, hydraulic cylinders 44 and 58 are preferably counter-actuated to maximally retract slide shafts 40 and 54.

While both shafts 66 and 80 of the feet are raised for ground clearance and for maneuvering of the crane support 1, a valve (not depicted) controlling hydraulic fluid flow to hydraulic cylinder 32 is preferably closed, preventing pivoting motion of pedestal 2 about axle 16. Opening of such valve releases hydraulic cylinder 32, allowing the foot assemblies to hydraulically operated for pivoting and counter-pivoting the pedestal 2 about the longitudinal axis.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A crane support comprising:

(a) a mounting frame;

(b) a pedestal having a crane supporting upper end, and having a front end, a rear end, and a longitudinal axis extending from the front end to the rear end, the pedestal being mechanically linked to the mounting frame;

(c) crane mounting means fixedly attached to or formed wholly with the crane supporting upper end of the pedestal; and, (d) means for alternately pivoting and counter-pivoting the pedestal comprising an axle and comprising laterally extending outriggers, each laterally extending outrigger having a proximal end and a distal end, each laterally extending outrigger comprising a plurality of segments and first telescoping means connected operatively to the segments for alternately laterally extending and retracting the distal ends of the laterally extending outriggers, the means for alternately pivoting and counter-pivoting the pedestal being connected operatively to the pedestal, the means for alternately pivoting and counter-pivoting the pedestal controlling pivoting movements of the pedestal about the longitudinal axis while the pedestal remains mechanically linked to the mounting frame; the means for alternately pivoting and counter-pivoting the pedestal further comprising a first plurality of quill and slide shaft combinations attached to the distal ends of the laterally extending outriggers, and second telescoping means being operatively connected to the first plurality of quill and slide shaft combinations, the second telescoping means being adapted for alternately downwardly extending and upwardly retracting the first plurality of quill and slide shaft combinations.

2. The crane support of claim 1 further comprising releasable locking means connected operatively to the pedestal, the releasable locking means being adapted for alternately resisting and permitting pivoting motions of the pedestal about the longitudinal axis.

3. The crane support of claim 2 wherein the first and second telescoping means comprise a plurality of hydraulic cylinders.

4. The crane support of claim 3 wherein the releasable locking means comprises a hydraulic cylinder.

5. The crane support of claim 4 wherein the laterally extending outriggers' segments comprise a second plurality of quill and slide shaft combinations.

6. The crane support of claim 5 wherein the pedestal has a lower end, and further comprising a base fixedly attached to or formed wholly with the lower end.

7. The crane support of claim 6 wherein the first and second pluralities of quill and slide shaft combinations comprise lengths of steel square tubing.

8. The crane support of claim 7 wherein the pedestal comprises a length of steel square tubing.

9. A crane support comprising:

(a) a mounting frame;

(b) a pedestal having a crane supporting upper end, and having a front end, a rear end, and a longitudinal axis extending from the front end to the rear end, the pedestal being mechanically linked to the mounting frame;

(c) crane mounting means fixedly attached to or formed wholly with the crane supporting upper end of the pedestal; and, (d) means for alternately pivoting and counter-pivoting the pedestal comprising an axle and comprising laterally extending outriggers, each laterally extending outrigger having a proximal end and a distal end, the means for alternately pivoting and counter-pivoting the pedestal being connected operatively to the pedestal, the means for alternately pivoting and counter-pivoting the pedestal controlling pivoting movements of the pedestal about the longitudinal axis while the pedestal remains mechanically linked to the mounting frame, and further comprising a forwardly and downwardly extending outrigger fixedly attached to the pedestal.

10. The crane support of claim 9 wherein the forwardly and downwardly extending outrigger comprises a quill and slide shaft combination.

11. The crane support of claim 10 wherein the forwardly and downwardly extending outrigger further comprises a two way hydraulic cylinder mounted for alternate extension and retraction of the slide shaft.

* * * * *